US008931852B2

(12) United States Patent
Enkhbold et al.

(10) Patent No.: US 8,931,852 B2
(45) Date of Patent: Jan. 13, 2015

(54) METHOD OF MINERAL FUEL BENEFICIATION WITH SUBSEQUENT DELIVERY TO THE CONSUMER BY PIPELINE TRANSPORTATION

(75) Inventors: Chuluun Enkhbold, Ulaanbaatar (MN); Brodt Alexander, Ulaanbaatar (MN)

(73) Assignee: Chuluun Enkhbold (MN)

( * ) Notice: Subject to any disclaimer, the term of this patent is extended or adjusted under 35 U.S.C. 154(b) by 60 days.

(21) Appl. No.: 13/808,602

(22) PCT Filed: Jan. 24, 2011

(86) PCT No.: PCT/IB2011/050294

§ 371 (c)(1), (2), (4) Date: Jan. 7, 2013

(87) PCT Pub. No.: WO2012/101478

PCT Pub. Date: Aug. 2, 2012

(65) Prior Publication Data

US 2013/0099552 A1 Apr. 25, 2013

(51) Int. Cl.

| | |
|---|---|
| ***E21C 41/18*** | (2006.01) |
| ***E21C 41/16*** | (2006.01) |
| ***B03B 9/00*** | (2006.01) |
| ***C10L 1/32*** | (2006.01) |
| C10L 9/00 | (2006.01) |
| ***C22B 1/00*** | (2006.01) |
| ***F23K 1/02*** | (2006.01) |
| ***F23K 3/02*** | (2006.01) |
| ***E21F 13/00*** | (2006.01) |

(52) U.S. Cl.

CPC ..... *E21C 41/16* (2013.01); *B03B 9/005* (2013.01); *C10L 1/326* (2013.01); *C10L 9/00* (2013.01); *C22B 1/00* (2013.01); *F23K 1/02* (2013.01); *F23K 3/02* (2013.01); *B03B 9/00* (2013.01); *E21F 13/002* (2013.01)

USPC ..... 299/8; 299/18

(58) Field of Classification Search

USPC ..... 299/8, 18

See application file for complete search history.

(56) References Cited

U.S. PATENT DOCUMENTS

| | | | | |
|---|---|---|---|---|
| 2,754,101 | A * | 7/1956 | Haworth et al. | 299/18 |
| 3,874,733 | A * | 4/1975 | Poundstone et al. | 299/17 |
| 4,178,231 | A * | 12/1979 | Smith et al. | 209/3 |
| 4,247,229 | A * | 1/1981 | Evans | 406/79 |
| 4,451,088 | A * | 5/1984 | Wisseroth | 299/11 |

* cited by examiner

*Primary Examiner* — John Kreck

(74) *Attorney, Agent, or Firm* — Galbreath Law Offices, P.C.; John A. Galbreath

(57) ABSTRACT

A method of mineral fuel beneficiation with subsequent delivery to the consumer by pipeline transportation relates fuel and energy complex and can find application in coal and slate energetics. Invention main objective is security of solid fuel delivery from mine (or an open cut coal mine) in already enriched form, with its subsequent through delivery to the consumer by pipeline on any distances in stream mode, without any intermediate transshipment operations. For this purpose use liquid with set complex physical, sanitary-and-hygienic and ecological properties, simultaneously, in 4 qualities: As environment for grinding material that needed further reduction of size; As separation environment for the subsequent, after reduction of size, deep underground gravitational enrichment of combustible mineral, As motionless filler of the vertical pipeline, for buoyancy in it ready product from mine on terrestrial surface: As carrying medium for final drift of end-product to the consumer by main pipeline. Depending on consumer type of solid fuel, a time of year, and weather conditions in which such, non-polluting, mining-energetic complex functions, there are used various technological approaches as to the general principles of construction of such, non-polluting, beneficiating transport technological process as well as within the limits of separate links of such technological chain, various methods of the regeneration, used many functional liquids which are in the closed contour of circulation between producer of solid fuel and its consumer.

13 Claims, 14 Drawing Sheets

METHOD OF MINERAL FUEL BENEFICIATION WITH SUBSEQUENT DELIVERY TO THE CONSUMER BY PIPELINE TRANSPORTATION

BACKGROUND OF THE INVENTION

1. Field of the Invention

The present invention relates to mining of different kinds of power generating fossils and can be used in coal, shale mining, and other branches of mining industry connected to solid fuel consumers via transportation infrastructure facilities.

2. Description of Related Art

The traditional method of providing various consumers with coal or another solid mineral fuel is well known. To this end, the run-of-mine coal is delivered to the earth surface storage by skip hoists and concentrated at a coal-concentrating plant. Then, thus produced high-quality solid fuel is shipped from the finished product storage to the consumer via railway transport.

Cleaned coal arrived to the destination point is discharged from cars, piled up at open areas, and then delivered for its direct application (see, e.g., Golitsyn M. V., M. B Golitsyn A. M. Everything About Coal. Moscow, Nauka Publishers, 1989.-192 pp.)

The above production string includes several storage operations, which is necessary due to cyclic character of mine skip hoists operation and railroad transportation mode.

However, the overwhelming majority of consumers introduce solid fuel into their processes continuously, rather than periodically and, what is more, at high rates. For example, the coal consumption of a modern fuel-burning power plant is measured by hundreds, and sometimes by thousands tons per. Accordingly, to avoid the hazard of power generation interruption, especially in winter periods characterized by peak power consumption accompanied with not infrequent coal delivery irregularities due to snow banks, the open fuel stores can reach hundreds of thousands and even millions tons.

However, coal, in contrast to quartz sand, is not a chemically inert material and it cannot be stored out of doors as long as is wished without losing its consumer properties.

In the course of railroad transportation and during the out-of-door storage, the irreversible processes of coal oxidation by the air oxygen are started and developed. By this reason, huge piles of coal become the source of regularly occurring fires, to say nothing of the fact that even without combustion, the irreversible endogenous oxidation processes of coaly substance taking place in such coal piles decrease substantially the calorific value of coal, which results in the increase of solid fuel demand and consequently, to a significant drop in power production efficiency.

Besides, The accumulation of such huge volumes of coal means, in essence, the formation of secondary, this time, anthropogenic coal deposits. The delivery of fuel for combustion from such 'deposits', especially in winter, when coal loses its flowability and fuses into a frozen monolith, becomes no less, and sometimes even more cumbersome than mining from natural deposits, where the coal brittleness remains unchanged over the entire course of coal field development.

In winter, no less daunting problem is coal discharge from railroad cars, especially when wet concentration methods are used. Coal fuses into a frozen mass and forms a single lump with the car.

Thus, the use of railroad transport for solid fuel delivery, in particular, to large power plants, especially in winter, results in the necessity of dual mining: first, from a natural deposit and then, from an artificial, anthropogenic 'deposit'.

Apart from the irreversible loss of a substantial fraction of coal consumer value, the intermediate storage and railroad transportation of coal together with numerous handling operations throughout the whole process, from the mine coalface to the power plant boiler furnace, result in significant mechanical losses of flowable material due to intense dusting. In fact, only coal blowing by wind during railroad transportation results in losses of 2 to 5 tons of coal per car, depending on coal coarseness, weather, and train speed.

Besides huge economical losses, with regard for the fact that annual world coal production is measured by billions of tons, the coal dust ingress into environment represents a serious ecological and pressing sanitary problem, in particular, for communities located in the immediate vicinity of coal dusting sites.

A method closest to the present invention from the viewpoint of technical essence and effect produced is the use of aqueous magnetite suspension for coal concentration and subsequent transportation to the destination point (see, in particular, the U.S. Pat. No. 5,169,267).

The use of aqueous magnetite suspension as a carrier medium for coal transportation via pipeline allows to eliminate the railroad transport services and to create an integrated stream-handling concentration and transportation process. The large-sized solid fuel is processed at a gravity coal-concentrating plant and delivered directly to a destination point using the pipeline transportation only. Note that the use of magnetite suspensions for coal beneficiation is well established and the most commonly encountered beneficiation method in the world coal mining industry.

However, the magnetite density (5.2-5.5 g/cm$^3$) exceeds that of coal (1.3-1.5 g/cm$^3$) by several times. By this reason, this artificial heavy medium, aqueous magnetite suspension, which is unstable under stationary conditions, cannot be used for the separation of coal from waste rock under these conditions. Even storage of this suspension, to say nothing of any beneficiation processes, requires intense mixing to prevent magnetite deposition. However the stable maintenance of magnetite in suspended state by constant agitation requires continuous power consumption. Besides, the intense agitation mode maintained in various separation devices prevents from clear separation of particles with close densities representing aggregates of coal with waste rock. This results in inevitable contamination of coal concentrate with mineral impurities, as well as coaly substance carryover to dump together with dressing tails; this is especially true for coarse fractions of material being processed. Therefore, a deep beneficiation of coal requires breaking of aggregates achieved by the continuation of grinding.

However, with the size reduction of raw material, the size of suspensoid particles used for the preparation of heavy medium becomes more and more, comparable with that of minerals to be separated.

As a result, the role of fluid used for the separation of fine-dispersed material plays water itself, rather than heavy suspension. However, the density of water is too small to provide the efficient lamination of minerals constituting the raw material. By this reason the coal beneficiation using heavy magnetite suspensions does not represent a universal beneficiation process. This leads to the necessity of using flotation at coal concentrating plants for the concentration of coal fines, which may constitute up to one third of total mine mass volume, bearing in mind modern means of mining face winning mechanization.

However, the flotation beneficiation methods are by an order of magnitude more expensive than the gravity methods. Besides, stockpiling of coal flotation beneficiation tailings nearby the coal concentrating plant remains a heavy ecological problem still waiting for solution, which would be satisfactory from all viewpoints.

The discrete structure of magnetite suspension prevents from using such heterogeneous media as heavy liquids for hydrostatic lift of coal from the mine to earth surface by direct floating-up in a vertical well filled with this heavy medium: under stationary conditions, when liquid is at rest, magnetite irreversibly precipitates in such a vertical column several hundred meters high, liquid loses heavy medium properties, and a dense magnetite plug is formed at the bottom of this pipeline.

Under high stream turbulization conditions taking place in trunk pipelines, magnetite may precipitate in the case of force-majeure events only, e.g., pumping station power supply failure, terrorist attacks, etc.

However, in any case, the use of magnetite suspension as a carrier medium in long distance pipeline transportation systems results in a drastic increase of electric power consumption, since, to avoid magnetite precipitation, coal—suspension mixture should be accelerated to substantially higher velocities than coal—water mixture. Another problem is a high erosion wear of pipes and centrifugal pump working wheel caused by highly abrasive particles moving with high velocities. Note that the increase of pipeline stream velocity is accompanied with the squared increase of power consumption (the 3-fold increase of velocity requires the 9-fold increase of power). The abnormally high viscosity of such heterogeneous systems also contributes to the increase of power consumption.

Apart from excessive consumption of power, inevitable use of high speeds for coal hydrotransport assists the intensification of coal wearing-off by high-abrasive magnetite and, therefore, the degradation of coal delivered to the consumer and increase of mechanical losses due to increased dust formation after dry coal withdrawal from the carrier medium.

The increase of coal fines content results not only in the degradation of coal and increase of dusting during all subsequent operations, but aggravates the problems of separating water and paste-like sludge produced in the course of trunk pipeline transportation, of dry coal output, and drastically restricts the possibilities of non-fuel use of coal, e.g., for coke production, as well.

There is no escape from taking into account the fact that the overwhelming majority of fossil coals are methane-containing. Accordingly, during coal destruction, the total coal-contained methane volatilizes and finally comes into the air, which not only decreases substantially the fuel heat capacity, but irreversibly damaging environment as well, since methane, along with refrigerants (Freons) is one of the main destructors of the Earth stratosphere ozone layer.

Also, the presence of solid heaver like magnetite in the carrier medium results in a drastic drop of transport channel throughput rate, because a large portion of pipeline internal volume shall be occupied by foreign solid substance required to increase the carrier density to a level providing the coal lumps flotation, at least in motion.

The water freezing temperature being 0° C., this makes impossible the large-scale use of aqueous magnetite suspensions as carrier media for trunk pipeline transportation of coal in winter. However, for the majority of consumers, the maximum demand for solid fuel falls namely on winter periods; similarly, negative temperatures aggravate the problems of uninterrupted coil delivery by railroad transport due to high freezing of coal in both the railroad cars and outdoor piles.

BRIEF SUMMARY OF THE INVENTION

Technical Solution

The present invention is aimed at the decrease of the power intensity and increase of productivity, simplification of functioning and improvement of reliability of the entire mining and power generating system, avoiding solid fuel losses throughout the whole technological line and elimination of some intermediate elements of this line, improvement of consumer properties of fossil coal delivered to the destination point, increase of coal use completeness, providing the transportation channel uninterruptible operation in winter, as well as reducing the unfavorable impact of entire mining and power generating system on the environment.

In the proposed method of beneficiating fossil fuel with the subsequent delivery to the customer by means of pipeline transportation, the above objective is attained by screening the original mined rock into several fractions at the production site, additional crushing the upper product, subsequent submersion of the crushed product, along with a part of initial mined rock freed from powder-like fractions, into liquid, the density of said liquid being intermediate between those of fossil fuel and rock refuse, grinding and separating of fossil fuel and rock refuse in said liquid followed by the delivery of the concentrated product to the earth surface due to floating up in liquid medium exhibiting higher density, subsequent delivery of concentrated fossil fuel to the destination point in the same natural heavy liquid flow, carrier medium regeneration and return to the fossil fuel production site, where, in parallel, said carrier medium is removed from the surface of rock refuse and an additional flotation is imparted to a part of finished product using aqueous media with dissolved mineral salts, or non-aqueous volatile fluids, or liquefied gases as natural liquid with a density value intermediate between those of fossil fuel and rock refuse.

The selection of heavy fluid composition and method of carrier medium regeneration depends on the kind of fossil fuel, particular consumer, and meteorological conditions of the process.

Mainly due to performing the beneficiation process in the immediate vicinity of the mining face, the beneficiation of fossil fuel, in particular, coal, with subsequent delivery to the consumer using the above-described method results in drastic reduction of total power consumed by this mining facility and fundamental decline of its adverse environmental impact due to the elimination of displacement (especially along the vertical) of huge waste rock volumes by large distances, to say nothing of clearing the territory around the mine from waste rock piles. Placing the tails of this underground beneficiation process in the waste space not only prevents falling of the earth surface and associated irreparable damage of all objects located within the zone of underground mining works, but delivers cost-free filling mass for these mining works as well, thus allowing to control geomechanical processes of overlying rock motion.

Mining mass grinding in liquid medium having a density intermediate between those of coal and waste rock, with the separation of coal and waste rock in this medium followed by deep beneficiation of fossil fuel in the same heavy fuel allows to prevent further destruction of coal lumps requiring no further size reduction. This sparing mode of grinding not only contributes to energy consumption reduction, but substantially increases the yield of most valuable coal grades free from coal fines as well, thus improving the quality of product. Combined with the utilization of a part of coal-contained methane, non-freezable carrier medium, a drastic decrease of pipeline transport power consumption and maximum possible preservation of initial size of material delivered by pipeline, the process suggested allows to reduce the cost of solid fuel supplied to various consumers, and simultaneously to improve the main consumer properties of coal.

Thus, the main distinctive features of the invention are naturally interconnected, and the objective of the invention is achieved only due to such combination of these features. The patent search and literature survey revealed no evidence of methods similar or technologically analogous to the suggested technical solution which allows concluding of the essential character of distinctive features thereof.

DETAILED DESCRIPTION OF THE INVENTION

The method suggested is implemented by consecutive performance of the following operations:

- screening the initial mining mass with additional crushing of oversize, blocks, and large lumps of coal followed by the size classification of material prepared for further integrated treatment;
- dry beneficiation initial raw material portion requiring no additional crushing and subsequent placement of the separated waste rock in waste space;
- wet beneficiation in heavy water-salt medium of raw material portion that cannot be efficiently separated using dry methods;
- wet beneficiation in non-aqueous volatile heavy liquid of raw material powder-like portion that cannot be efficiently beneficiated in heavy water-salt medium;
- wet grinding of material requiring additional size reduction in liquid with a density intermediate between those of coal and waste rock, accompanied with wet separation of coal and waste rock in this medium;
- placing wet beneficiation wastes into waste mining space preceded by the removal of heavy liquid from the surface of filling material;
- preparing coal for delivery to the surface;
- lifting coal from the mine to the earth surface by direct floating-up in a vertical well;
- delivering coal to the destination point via pipeline by the liquid flow;
- carrier medium regeneration and return to the coal production site.

The principle of the invention becomes clearer from the following drawings illustrating separate fragments of the integrated beneficiation—transportation facility, most substantial from the technological novelty viewpoint.

Example 1

Figure 1:
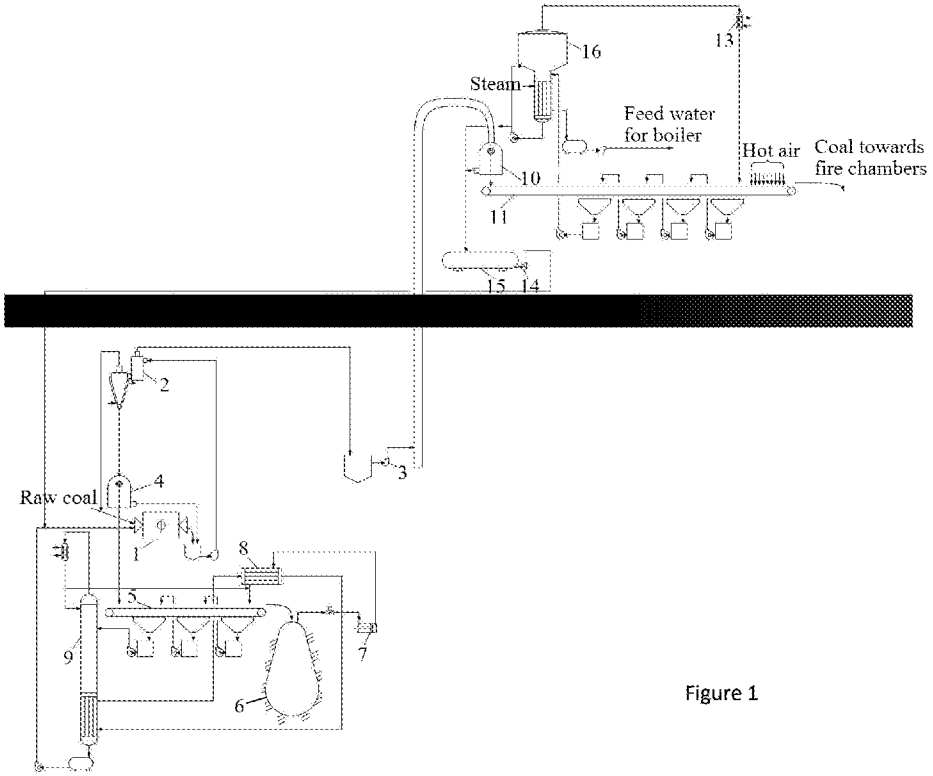
FIG. 1 is a flow diagram showing the underground treatment process of the invention.

FIG. 1 shows the flow diagram of underground treatment process of the initial rock portion that requires additional size reduction under deep mining conditions, where the rock remains sufficiently heated by heat of interior the whole year round, irrespective of meteorological conditions, and when the coal produced is intended for a power plant.

This portion of initial rock separated by screening and requiring additional size reduction to improve waste rock separation is ground in rattler 1 flooded with liquid whose density is intermediate between those of fossil fuel and rock refuse. The rattler operates in closed cycle with three-product heavy-media hydrocyclone 2.

Liquid represents an aqueous solution of calcium nitrate/zinc chloride mixture having a density of 1.48 g/cm$^3$.

The beneficiated product, leaving hydrocyclone 2 remains suspended in heavy aqueous medium, which first brings the product to a pitbottom, and then by pump 3 and ground pumping stations (not shown) or, if applicable, by gravity delivers coal to the destination point (power plant).

Aggregates of solid fuel with waste rock that remained under-opened during wet grinding are discharged from the second section of hydrocyclone 2 and directed for additional grinding to rattler 1; waste rock separated from this technological stream is discharged from the tapered part of hydrocyclone cooled by external cooling agent (this results in the increase of the aqueous liquid density) and directed for dehydration into filtering centrifuge 4.

Dehydrated final tails are subjected to counterflow rinsing with non-aqueous volatile liquid, e.g., acetone, on band vacuum-filter 5 and supplied for filling the underground waste space 6.

After complete filling waste space 6 with wet filler, the space is walled-up and connected to the suction side of compressor 7 pumping out vapors of low-boiling non-aqueous liquid evaporated from the surface of filler material under the action of heat of interior.

Organic vapors pressurized by compressor 7 are liquefied in condensator 8. Thus regenerated volatile non-aqueous liquid is returned for cleaning the final tails impregnated with aqueous liquid.

Resulting wastes representing the mixture of organic liquid with water-salt medium are directed for distillation to rectification column 9 whose boiling part is heated with hot water taking away pressurization and condensation heat of vapors liquefied in condensator 8.

The distillation separates this mixture into initial heavy aqueous liquid, which is returned back to the beneficiation process, and regenerated non-aqueous organic volatile liquid directed back for rinsing beneficiation wastes impregnated with aqueous liquid phase residuals.

Concentrated coal delivered by the aqueous liquid flow to the power plant is subjected to a similar treatment, except for rinsing is performed with water, rather than with non-aqueous organic volatile liquid.

To this end, fossil fuel delivered via pipeline transport is first separated hydromechanically from liquid carrier using centrifuge 10 and then rinsed in a counterflow of hot water on band vacuum-filter 11, dried with hot air, crushed, and directed for combustion to the power plant furnace.

Waste water produced by rinsing and representing diluted water solution of mineral salt mixture, is evaporated in evaporator 12 heated using the exhaust steam (working medium of the power plant steam turbine thermodynamic cycle, in which the solid fuel combustion heat is transformed into electric power) or other waste heat, e.g., the waste heat of flue gas discharged to the atmosphere. In the case of exhaust steam, condensate 12 formed in the evaporator is returned to the power plant steam boiler and used again to produce high pressure working steam.

Secondary steam from evaporated solution comes from evaporator 12 to condensator 13 and is transformed into condensate returned as hot rinsing water for counterflow rinsing solid fuel and removing the residues of aqueous salt solution remained after treatment in centrifuge 10.

The solution evaporated in evaporator 12 to the initial density is mixed with centrifuge centrate produced during the solid fuel dehydration in centrifuge 10 and returned back to the place of solid fuel production and beneficiation using pumps 14 (shown in the diagram is only one such pump).

Example 2

Figure 2:
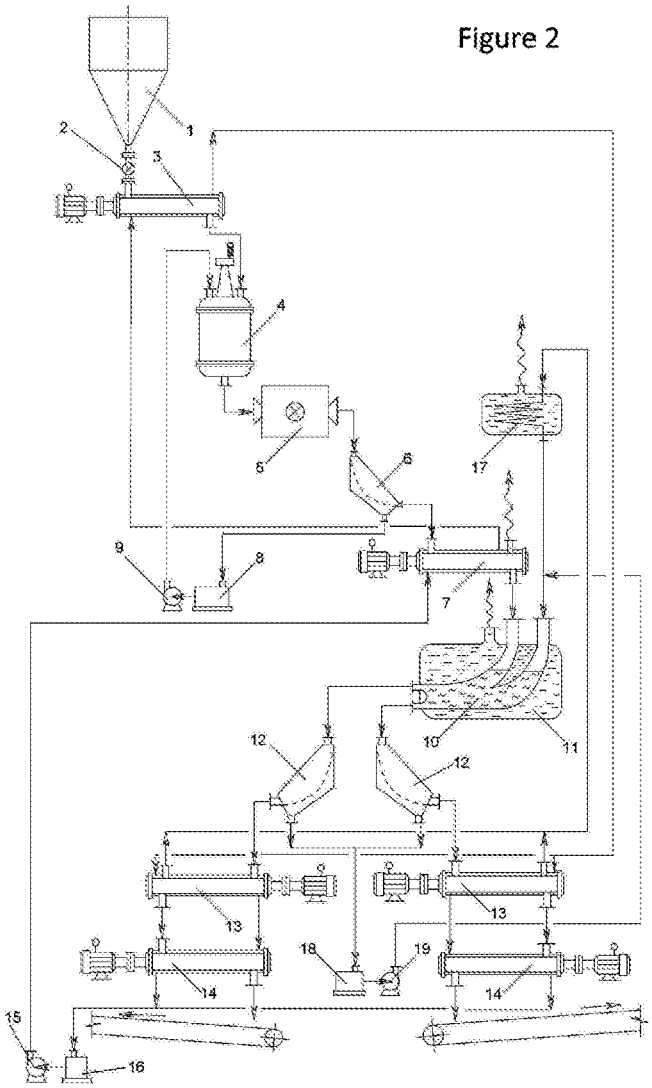
FIG. 2 is a flow diagram showing the underground beneficiation of a powder-like mass resisting highly selective dry separation.

FIG. 2 shows the flow diagram of underground beneficiation of powder-like mass resisting highly selective dry separation. Treating this part of raw material in aqueous solutions of mineral salts results in the reduction of separation efficiency due to increased effect of water-salt medium rheological characteristics on highly dispersed material, while, a high humidity of paste-like beneficiation products leads to the increase of power consumption associated with the discharge of dry coal and dry final tails.

In this case, liquid argon, non-aqueous cryogenic liquid with a density intermediate between those of fossil fuel and rock refuse, is used as a separating medium. The boiling point of this liquid is so low that the discharge of dry beneficiation products takes place automatically due to irreversible boiling-up of liquid phase residues due to contact with the environment.

To this end, initial powder-like run-of-mine coal is fed from bin 1 through gate 2 to recuperation cold exchanger 3 cooled by low-boiling refrigerant for preliminary cooling. Material cooled in this exchanger to cryogenic temperatures is loaded into mixer 4 where material is agitated in liquid air. Mining mass suspended in liquid air is fed from mixer 4 to mill 5 also filled with liquid air.

Material is crushed into superfine powder, then it is fed to sealed arc sieve 6 for hydromechanical wringing out and is made finally free from liquid air by drying in drier 7. Liquid air separated from crushed material on sealed arc sieve 6, is returned from collector 8 using pump 9 to mixer 4, while fine-grained mixture of minerals disaggregated by crushing in mill 5 is separated into superclean coal concentrate and final tails in separator 10 filled with cryogenic heavy liquid whose density is intermediate between those target component (1.34 g/cm$^3$) and waste rock (2.65 g/cm$^3$). For coal beneficiation, such cryogenic fluid is liquid argon having a density of для обогащения угля выступает жидкий аргон имеющий плотность 1.40 g/cm$^3$ and freezing point −189.3° C.

The density of this liquid is inadequate for beneficiation of fossil fuels with higher densities, like anthracite or bituminous shale. In this case, liquid krypton (density 2.4 g/cm$^3$) is admixed to liquid argon.

For maintaining argon in liquid state, separator 10 is mounted in cold insulated tank 11 made as Dewar filled liquid air. At big mining depths, liquid air boiling point is noticeably higher than −189.3° C. Liquid argon cannot freeze at a somewhat elevated value of underground air pressure, which guarantees maintaining it in liquid state during underground beneficiation process. If the separation process is performed under strip mining conditions, the cold insulated tank installed in the strip mine is equipped with a control throttle valve, and liquid air boils at a higher than atmospheric pressure.

Hydromechanical wringing-out of beneficiation products from liquid argon carried out of the separator is performed on sealed arc sieves 12. The final removal of the last argon residues is achieved by evaporation from concentrate and tail surfaces in driers 13. Then these completely dry, but extremely cold solid beneficiation products are fed to cold exchangers 14 heated by condensation heat of gaseous oxygen or other low-temperature agent used for cold transfer from the beneficiation products to initial rock. The circulation of this refrigerant is maintained using pump 15 feeding it from collector 16 to drier 7 and further to recuperation cold exchanger 3, in which the boiling heat of this low-boiling liquid is drawn from the flow of solid mineral raw material coming for treatment.

Further, dry beneficiation products whose cold was transferred to low-of recuperation cold exchange equipment (not shown), in which their temperature rises gradually to that of ambient air, and then delivered by mine transport to their respective destination points: final tails are used as filling material, and superclean coal concentrate is transported to mine winders discharging it to the earth surface.

Argon vapors separated in driers 13 from beneficiation products are fed for liquefaction to condensator 17 representing a worm pipe merged into Dewar filled with boiling liquid air. Thus regenerated liquid argon returns to separator 10.

Liquid argon separated from beneficiation products on arc sieves 12 is accumulated in collector 12 and returned by pump 19 to the same separator 10.

The delivery of this superclean coal concentrate by flotation may be performed both together with lumpy coal and separately from it. These options are illustrated by the following two examples. In this case lumpy coal is a methane carrier. Accordingly, the associated transportation of methane entrapped in large coal lumps to a power plant substantially increases the calorific value of this solid fuel and contributes to preservation of stratosphere ozone layer.

The large lump material, and powdery coal are delivered to a surface by its buoyancy in the vertical pipeline.

Depending on local conditions, such process of delivery can be both joint, and separate.

Example 3

Figure 3:
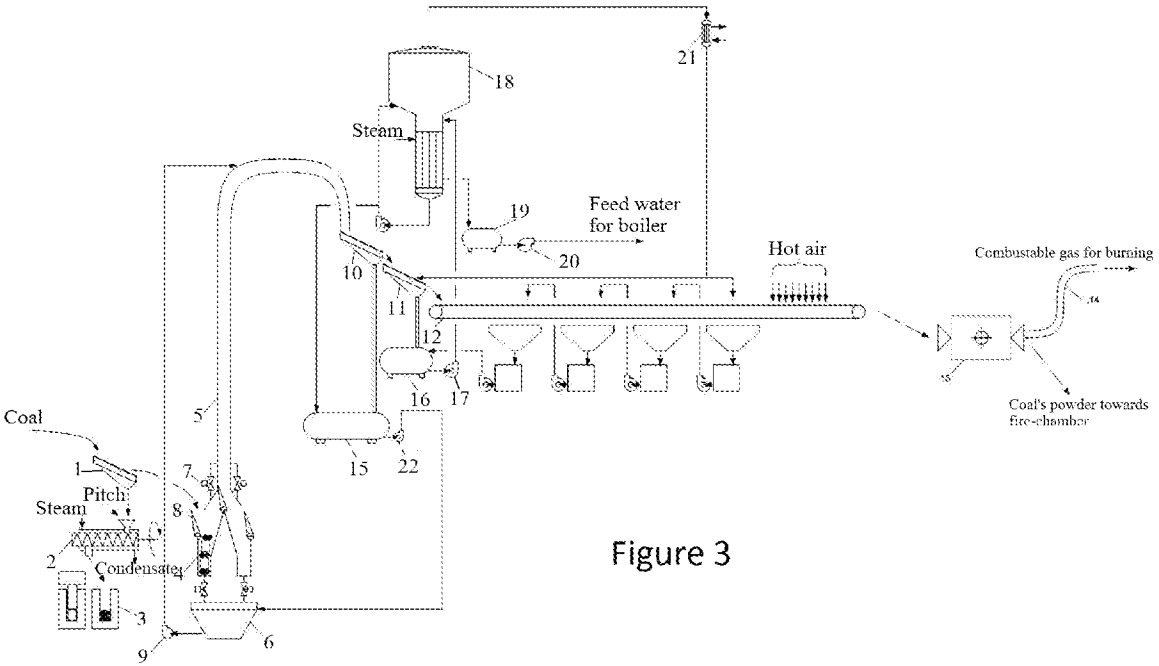
FIG. 3 is a flow diagram showing the joint delivery of lumpy and powdery coal from a surface mine, where the consumer of such fuel is a thermal power station.

On FIG. 3 is represented the basic technological scheme of joint delivery lumpy and powdery coal from mine on surface in case the consumer of such firm fuel is the thermal power station.

Coal delivered in main stream from mining faces to the shaft bottom is classified on separator 1 into lumpy material and fines comprising both fine pieces of coal and all its dusty fractions.

Coal fines separated from lumps and large pieces are fed by screw feeder 2 equipped with a heat-exchange jacket to press mold 3 for pressing. A moderate amount of pitch is introduced into screw feeder 2 as a binding additive, which strengthens monolithic blocks made from coal fines in the form of cylindrical bodies resembling pistons of hydraulic facilities by their shape. Steam for heating coal mixture with pitch before pressing is fed into its heat-exchange jacket.

Batches of lumpy coal and coal blocks apiece are alternately arranged in loading chamber 4 of the loading system of transport pipeline 5 in such a way that coal 'pistons' are alternated with batched of the pourable mixture of pieces with lumps of coal. Loading chambers 4 are alternately emptied, in the antiphase to each other, from the liquid filling them, which constitutes the working medium of the entire transport process representing an aqueous solution of calcium nitrate with the density 1.42 g/cm$^3$ (the coal density being 1.39 g/cm$^3$).

Discharged portions of this liquid are collected in waste container 6, while loading chambers 4 are alternately flooded with the contents of pipeline 5, after being loaded with coal, using cocks 7 and a system of controllable shutoff gates 8. As a result, the coal floats out of the mine to the ground surface and then floated in the flow of the carrying aqueous medium to its destination. The flow of said liquid carrier in the horizontal part of pipeline 5 is generated by feeding a liquid jet by pump 8 from waste container 6.

(However, in case of the development of mountainous coal deposits, it is much more energy-profitable to use gravity-based operation of said hydrotransport, without generating an artificial flow of the carrier liquid in the transport pipeline).

The coal delivered to the heat power plant is hydromechanically separated from the carrying liquid on separator 10, and then rinsed with fresh water on separator 11 and overloaded to band vacuum-filter 12, where it is additionally washed with water in the counter-current mode, finally squeezed from the residues of washing water and dried with hot air or some other heat-transfer medium before starting grinding the former for producing dusty fuel.

Coal powdering is carried out in hermetic ball mill 13. Methane and other combustible gases released during this process enter pipeline 14 directing them to the boiler furnace of the heat power plant together with coal.

Drainage waste left from coal on shaker 10 are accumulated in collector 15, whereas washing water left after its rinsing on shaker 11, as well as final filtrate from band vacuum-filter 12 are directed to collector 16, wherefrom this technological flow is directed by pump 17 to evaporation in evaporating system 18.

Evaporation of this washing water is realized at the expense of condensation heat of the exhaust steam leaving turbines of the heat power plant, which represents a working medium of its thermodynamic cycle of coal combustion heat transformation into electric power. Therefore, the condensate formed in the intertube space of steam-generating tubes of evaporating system 18 flowing down into collector 19 is directed again by pump 20 to the steam-boiler of the heat power plant, where it is processed again into high-pressure working steam directed to steam turbines for expansion, closing in this way, the working medium circulation in the cycle of thermal energy conversion into electric one.

Juice water steam left after the evaporation of washing water in evaporating system 18 is condensed in condenser 21 and returned, in the form of hot washing water, to shaker 11 and band vacuum-filter 12 for coal rinsing.

Aqueous salt solution evaporated in evaporating system 18 up to its initial density of 1.42 g/cm$^3$ is mixed in collector 15 with drainage flow left after coal dewatering on shaker 10. The obtained mixture representing a completely regenerated aqueous liquid with the density exceeding that of coal is returned by pump 22 into container 6, to the initial loading site of coal supply.

In case of separate delivery of coal to the surface, the powdery material can be delivered in the vertical pipeline with its subsequent transportation to the consumer on the pipeline using for this purpose only waters as heavy liquid.

Figure 4A:
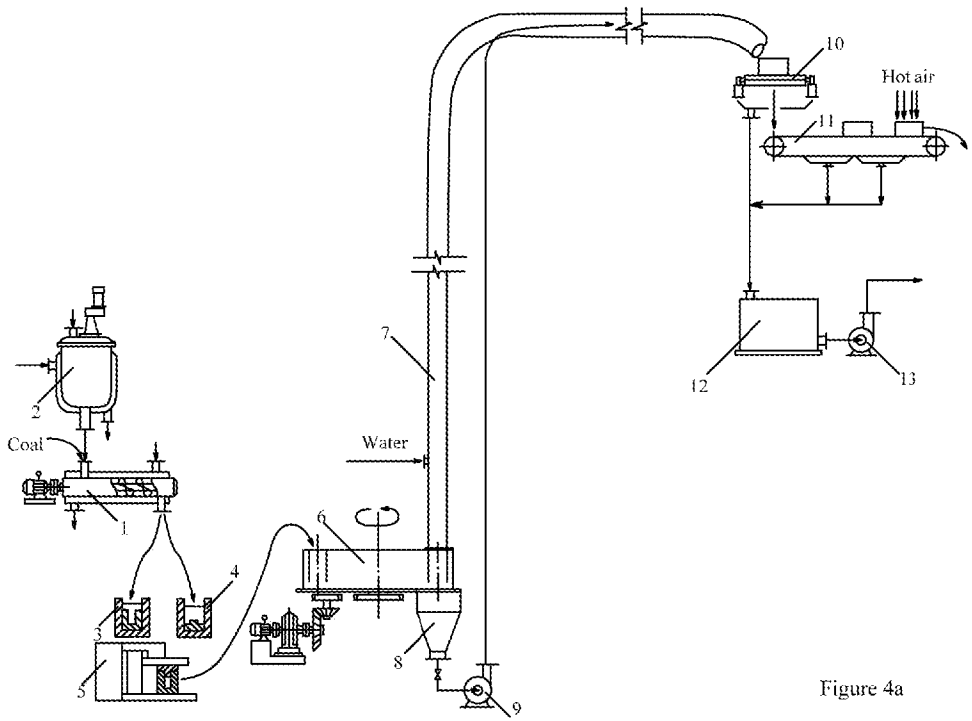
FIG. 4*a* and FIG. 4*b* are flow diagrams showing the transportation of dry powdery coal in the inventive process.
Figure 4B:
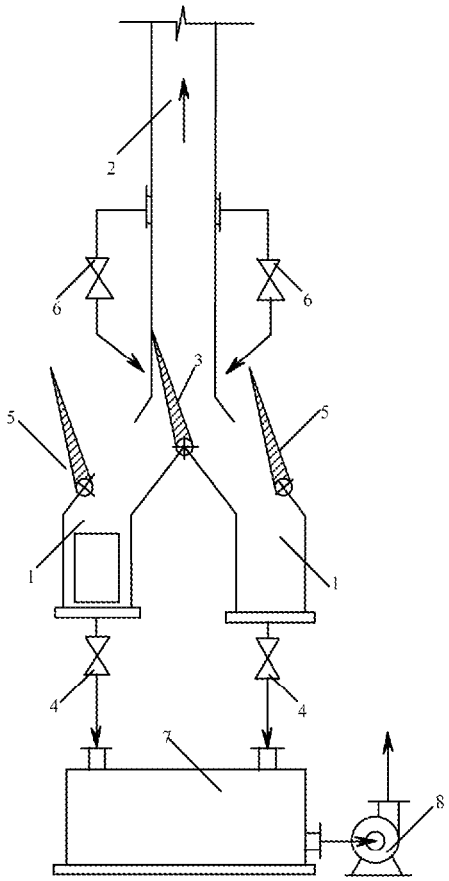

Technological schemes of such variant of fuel delivery from mine to its consumer are shown on FIGS. 4*a* and 4*b*.

Example 4

The initial dry powdery coal (FIG. 4*a*) is mixed at a shaft station in mixer 1 with binding additives (5-7% of the coal weight). The latter can include cracked residue, tar or other petroleum- or bitumen-based hydrocarbon materials fed from closed pan 2 heated by an external heat-exchange agent, or else other organic combustible binding agents such as sulfite-alcohol distillers, technical lignosulphonates, various wood resins, syrup-like wastes of sugar and caramel production (molasses) widely used in coal briquetting. At that, either heat-exchange agent is fed into heat-exchange jacket of such mixing device, or the mixture is heated by electric heating coils.

Hot (80-90° C.) mixture is filled into press molds 3 and 4 equipped with two types of punches, and both dies of the press molds 3 and 4 represent cylinders with the internal diameter corresponding to the internal diameter of the pipes of the hydraulic trans-portation system.

Press mold 3 is equipped with a punch of T-shaped cross-section. The external diameter of its central column is close to the internal diameter of the central axial cavity of another punch having the shape of an upturned glass, which belongs to the second press mold 4. Here the bottom of the glass inserted into the second press mold 4 is of elevated thickness in order to ensure a smaller vertical size of the axial cylindrical protrusion of the future second blank in comparison with the depth of the cylindrical axial hole made along the axis of the first blank.

As a result of pressing under an elevated (10-30 MN/m$^2$) pressure, articles formed in the first press mold 3 acquire the shape of thick-walled cylindrical glasses, while the products of the second press mold 4 look like mushrooms with thick caps and shortened stipe.

To assemble a hollow plunger-like block from these two blanks, the external lateral surface of the cylindrical protrusion of the blank with T-shaped cross-section, as well as the annular back surface of the cap of such 'mushroom' are smeared with molten petroleum- or bitumen-based hydrocarbon material, inserted one into another and tightly pressed together by a hydraulic press 5.

As a result, after final setting of this sticky substance, a hollow cylinder made of coal is formed from said two blanks shaped in press molds 3 and 4. Since its external diameter is close to the internal diameter of the transporting pipeline, it looks like a plunger of a hydraulic system.

Charging of coal pressed in the form of hollow thick-walled blocks into the vertical water column is realized using rotary lockage device 6 of a turret type allowing a complete mechanization and high efficiency of charging. During the rotation of the charging carrousel around its vertical axis, first of all, a consecutive cylindrical cell of such drum coming out from under the transporting pipeline 7 is emptied from water flooding it after a consecutive hollow coal block floats up. It happens at a complete matching of the section of its upper hole with the lower base of the vertical standpipe. Water flowing out of each cell is accumulated in collector 8 and pumped by centrifugal pump 9 into the horizontal part of transport pipeline 7. Coal is floated through it in a flow of the carrier medium like timber in a river to its destination.

Meanwhile, consecutive hollow coal blocks are inserted into the charging drum cells emptied from water. They are continuously charged, one after another, at each entry of a consecutive cell of the drum with a coal block in it under the lower section of transport pipeline 7, into the vertical water column. Thus, they are subjected to a continuous procedure of mechanical lockage.

As a result, a solid, continuously moving up kernel assembled of hollow coal plungers is gradually formed inside the vertical water column. Said plungers continuously float up from the vertical into the horizontal part of transport pipeline 7 as a garland of cylindrical bodies tightly ground to each other by their butts.

Then, owing to water current generated in this segment of the pipeline system by centrifugal pump 9, the floating chain of cylindrical hollow coal blocks is floated to the coal consumption site,—thermal power station or a center supplying local population with domestic solid fuel.

At the outlet of transport pipeline 7, roller bed 10 is installed (a side-view shown), which reloads coal cylinders delivered to the thermal power station to band vacuum filter 11 and also carries out primary drainage of water, which has brought them, from their surface.

Then, additional coal dehydration takes place on band vacuum filter 11, and at the finishing segment of the filter band, before its descent from the driving drum, the surface of coal blocks staying on it is finally drained from water residues by blowing with warm air. Water left from coal blocks and accumulated in collector 12 is directed by pump 13 to further consumption by external users.

Then dry coal blocks are either crushed and milled before being burnt in the furnace of a thermal power station, or transversely cut by a disk saw into washer-shaped briquettes for supplying population with coal for domestic needs (to be used as domestic fuel).

If it is not necessary to organize highly efficient mine hoisting of coal (for example, during tunneling and cleanup activities in the mine), the unit of coal blocks charging in the vertical water column can be executed in a much simpler configuration. As shown in FIG. 4*b*, it consists of lock compartments 1 divided into two legs communicating with the vertical part of transport pipeline 2 by a common rotary gate 3.

Such simple charger operates as follows. After emptying a consecutive lock compartment 1, from which a consecutive coal block has just floated up, from water by tap 4, the next coal cylinder is inserted, charging port 5 is tightly sealed, and tap 6 is opened in order to flood the free space left from coal in the lock compartment. Then a turn of the gate 3 in the opposite direction opens the way to the hollow coal cylinder charged into lock compartment 1 into the vertical part of transport pipeline 2. Meanwhile, the second (symmetrical) lock compartment 1 isolated at that moment from the vertical standpipe by the same gate 3 is emptied from water and charged with the next coal block.

As a result of such balanced antiphase operation of lock compartments 1 by means of continuous permutations of rotary gate 3 from one position to another, hollow coal blocks float up one after another in such vertical water column from the mine to the ground surface. Then they float by a horizontal (not shown in the Figure) segment of the transport pipeline to their destination.

Water forced out of lock compartments 1 and accumulated in collector 7 is pumped out to the ground surface by centrifugal pump 8 pumping it to the horizontal part of the transport pipeline.

However, shown in example 4, variant of coal delivery to the consumer by its buoyancy in water with the subsequent drift to delivery place on the pipeline is workable only during the summer period.

During the period of winter colds, especially, in the conditions of open-pit mining, enrichment and delivery of coal to the consumer is realized by different way, using ice in non-freezing water-salt solution as agent for additional buoyancy to transported cargo and for isolation of external surface of transported cargo from contact to the carrying medium.

Figure 5:
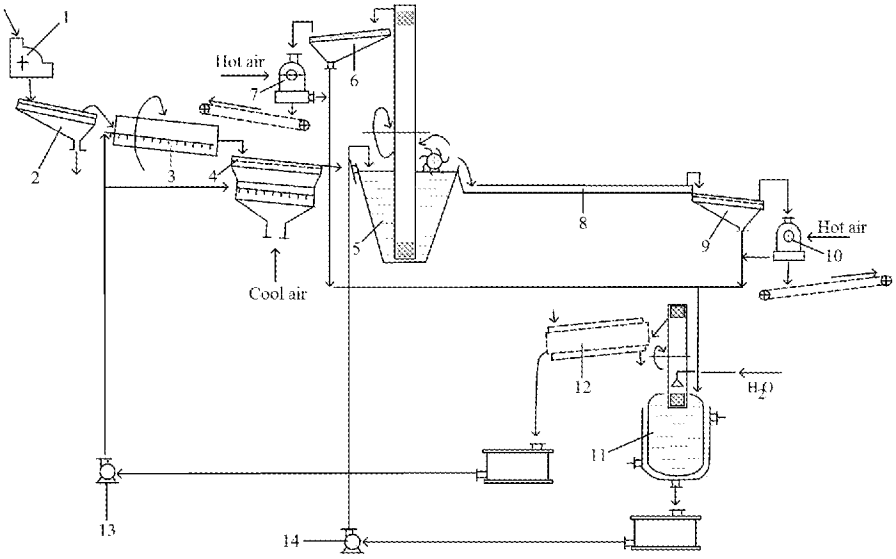
FIG. 5 is a flow diagram showing the enrichment and delivery of coal to the consumer during cold periods, such as in winter.

The technological scheme of such process is presented on FIG. 5.

Example 5

A flow of raw rock mass delivered from a mining face is crushed in crusher 1 and then dedusted in shaker 2. Material prepared in this way for the processing is moisturized with water in mixing drum 3 and transferred to non-falling sieve 4 blown through from below with cold atmospheric air, where ice coating is frozen on the surface of minerals to be separated. The ice coating thickness is regulated both by dosed water supply into mixing drum 3 and by feeding water aerosol under sieve 4. Said aerosol is fed into cold air flow by means of special sprayers and uniformly moisturizes the surface of mineral particles hovering in cold air flow with finely sprayed water. As a result, each particle is gradually covered with a firm ice layer, which totally isolates dressed material from subsequent contacts with water-salt medium.

Stratification of ice-encapsulated rock mass into final tailings and coal concentrate is realized in wheel separator 5 flooded with heavy water-salt medium representing a solution of a water-soluble mineral salt such as calcium nitrate or zinc chloride, etc.

Waste rock discharged from wheel separator 5 is dehydrated on drainage separator 6, and then liquid phase residues are finally removed from this material on centrifugal filter 7 blown through with warm air. At this stage, ice covering the solid surface thaws, which leads to the appearance of thawed water and fugate dilution with said water.

De-ashed coal remaining afloat in water-salt solution is transferred by pipeline 8 to its destination in a flow of non-freezing heavy liquid. Hydromechanical removal of such liquid carrier and final squeezing of the solid material from liquid phase residues are also realized using exactly the same equipment as that used for waste rock dehydration—drainage separator 9 and centrifugal filter 10 blown through with warm air for ice thawing.

Drainage flows and fugate left from dressing products are collected in freezer 11, where this solution diluted with water is cooled down to the temperature at which it starts freezing. The produced fresh ice floats up, and its removal from the surface of concentrated in this way water-salt solution is realized by an elevator wheel with perforated scoops, in which the ice is rinsed with fresh water.

Then the ice discharged from freezer 11 is melted in smelter 12, and the obtained thawed water is returned by pump 13 for moisturizing the initial material in mixing drum 3 and freezing ice coating on its surface carried out on shaker 4.

Heavy water-salt liquid completely regenerated in freezer 11 is returned to wheel separator 5 for its repeated use for separating minerals composing the initial mixture.

During the summer period, in the conditions of gratuitous natural cold absence, the role of ice for capsuling of divided minerals, and giving of additional buoyancy to coal, is carried out by fusible hydrocarbonic porous coverings of low density which reliably isolate surface of mineral components of mined mass from any contact to water, or water-salt solution. However, at replacement of ice by hydrocarbonic porous covers, such approach to give properties of buoyancy to coal pieces, it can be used not only for coal transportation in high concentrated water-salt mediums, but also for delivery such shielded by organic covering lumpy solid fuel to destination drift in the diluted solutions of mineral salts in water, and even in water stream.

Figure 6:
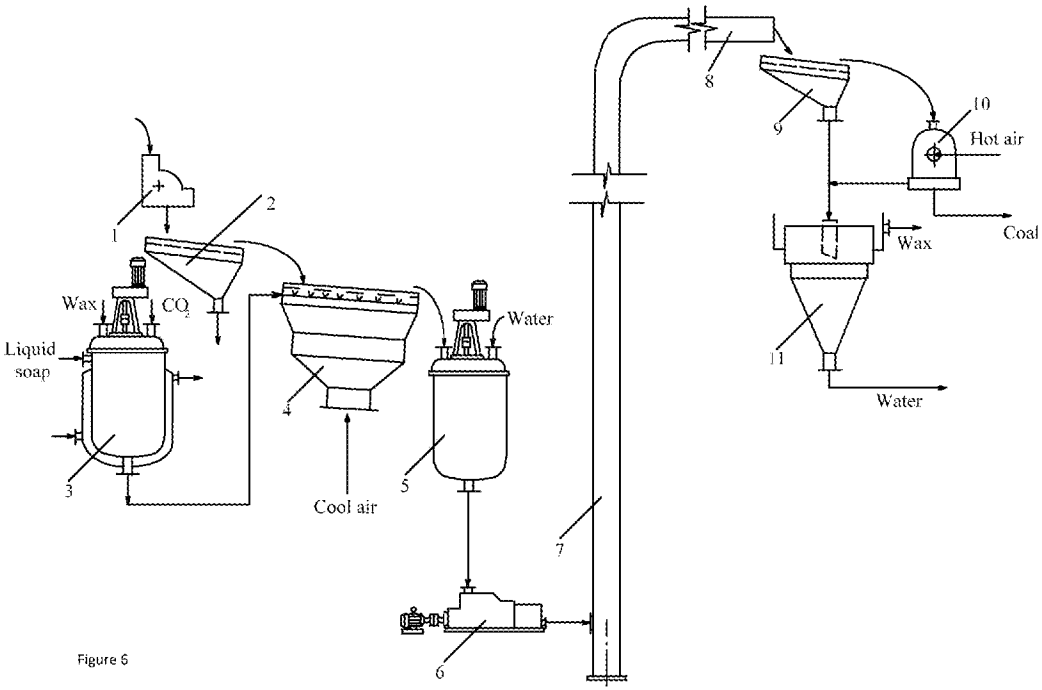
FIG. 6 is a flow diagram showing the enrichment and delivery of coal to the consumer during warm periods, such as in summer.

The technological scheme of such transport process is shown on FIG. 6.

Example 6

Mined and already beneficiated coal is delivered from the mining face to the shaft station, crushed in crusher 1 and dedusted on vibratory screen 2.

At the same time, thick foam is prepared in a hermetic (for maintaining elevated pressure) saturator 3 heated by an external heat transfer agent. Non-aqueous hydrocarbon oily liquid, such as highly viscous mazut or waste engine (or transformer) oil modified by various thickeners is abundantly saturated with some gas, for instance, compressed air, nitrogen, carbon dioxide, mine methane or other gaseous aliphatic hydrocarbons of alkanes series. To control rheological properties of such oils, certain hydrocarbon polymers, as well as derivatives of unsaturated esters such as, e.g., polyisobutylene, polyvinyl alkyl ethers, polyalkyl methacrylates and polyalkyl crylates, can be used as thickeners. Depending on meteorological environmental conditions, such intensely foamed compositions can be prepared on the basis of other easily melted hydrocarbons or their mixtures having suitable melting temperatures. They include paraffin, stearin, bitumen, tar, wax, margarine or fat production wastes, various syrups, oleoresin and its processing products, fir balsam and other resins, fats and oils of mineral, vegetable or animal origin. After their heating, some gases can be forced into them from the outside, but besides that, in the course of foam formation process, gas bubbles can be formed within their entire volume owing to chemical reactions accompanied by violent gas release. In this case, various chemically unstable powdery substances that can be decomposed with a release into the gaseous phase are introduced into such compositions,—for instance, carbon dioxide resulting from the interaction of sodium bicarbonate with citric acid or irreversible decomposition of such thermally unstable complexes as clatrate compounds such as methane gas-hydrates and other alkanes at their slight heating.

To increase the stability of the produced foam, surfactants can be additionally introduced into the heated hydrocarbon liquid, which is kept under elevated pressure in a saturator. Such surfactants are, e.g., pinewood oil, liquid soap, sulfonol, sodium oleate or tripolyphosphate, aniline, various lower alcohols and organic acids, and also creosols, which are efficient foaming agents ensuring much higher stability and thickness of the foam to be formed and imparting elevated stickiness to it.

After dedusting on vibratory screen 2, lump coal is fed to an inclined non-passing vibratory sieve 4 blown from below with cold air. At the same time, foaming liquid pressed out of saturator 3 by excess gas pressure in it, is injected into this flow of refrigerant flowing over the coal. It is realized using a distributing spraying collector with sprayers arranged along its length, just as a man applies a layer of foam from a cosmetic can before shaving.

As a result, colder (with respect to the foam solidification temperature) lumps of coal are uniformly coated with a layer of dense and easy-to-solidify sticky foam, which gradually becomes a continuous solid porous pumice-like coating.

The material covered with such solid porous coating is reloaded into mixer 5 along with mine water. The obtained thick slurry is pushed by piston pipe 6 into vertical pipe 7. The coal floats up to the ground surface and then is floated in the encapsulated form in the water flow by a horizontal main pipeline 8 to a thermal power station.

The coal delivered to its destination place is, first of all, released from water on vibratory screen 9 and then squeezed from the remaining water on centrifugal filter 10 blown from inside with warm air. At that, cream-like porous coating covering pieces of coal melts, and the resulting drainage filtrate represents a mechanical mixture of hydrocarbon liquid with water left from coal squeezing. This technological flow enters static separator 11, where the two-phase liquid system is stratified into two fractions. Light fraction representing a hydrocarbon liquid is delivered to the furnace of thermal power station boiler for combustion, while water is either supplied to a neighboring industrial or agricultural consumer or discharged into the nearest water reservoir.

The mentioned approach to shielding of processed material by porous covering, with equal success can be used for coating of such fusible water-proof coverings on surface not only coal, but also tailing minerals, before the stratification of mineral compo nents of mined mass in the heavy water-salt medium.

Besides, in conditions of soft winter, at moderately low temperatures of atmospheric air, or underground coal mining in permafrost zones, such foams can be prepared on water basis.

Figure 7:
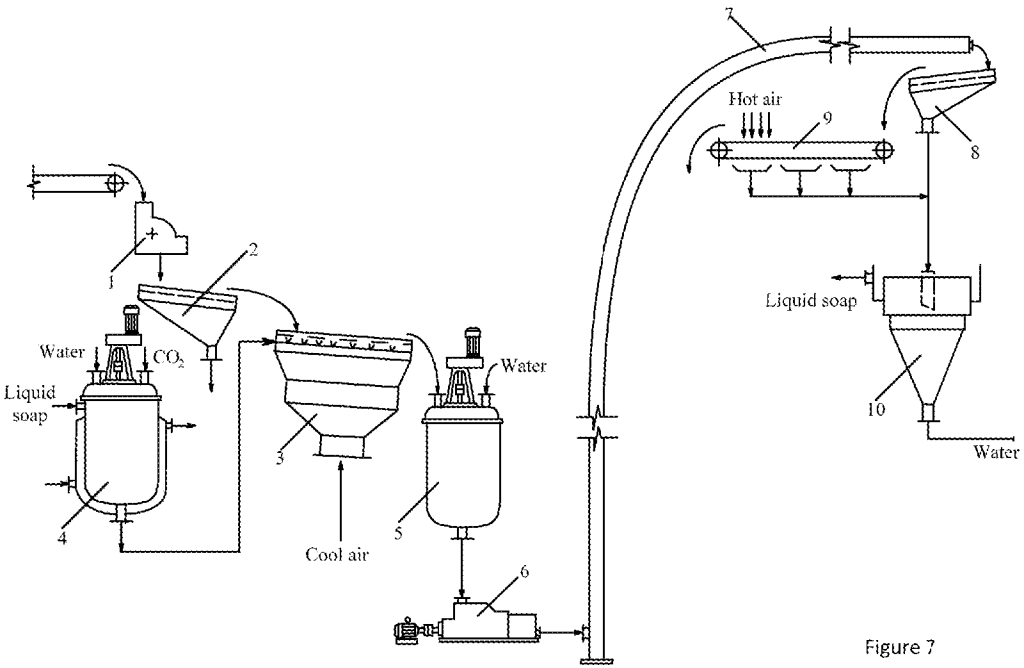
FIG. 7 is a flow diagram showing the enrichment and delivery of coal to the consumer in moderately low air temperatures, or when mining coal underground in permafrost zones.

The technological scheme of such process is presented on FIG. 7.

Example 7

Cold lump coal delivered by a belt conveyor from the mining face is crushed in crusher 1 and, after the removal of fine particles on vibratory screen 2, is fed to non-passing sieve 3 for smearing with dense sticky water foam.

The foam for covering coal lumps with porous ice is whipped in saturator 4 equipped with a heat-exchange jacket heated by an external heat transfer agent, in which ordinary water is saturated with carbon dioxide under an elevated pressure. Liquid soap and pinewood oil are added to water in saturator 4 as foam-forming and foam-stabilizing additives, respectively.

Freezing of a layer of porous ice coating on the surface of lumps of coal is realized by their spraying with jets of thick foam from a collector-distributor installed under non-passing sieve 3 in such a way that a layer of porous ice starts to form on the surface of coal moving downwards on air-cushion support and gradually becomes thicker.

Coal hovering above the external surface of non-passing sieve 3 is maintained by feeding cold atmospheric air from below in such a way that each lump is individually and uniformly overflown by a cold air flow from every side.

Then lumps of coal encapsulated with a layer of porous ice are suspended in mine water in mixer 5 and delivered using pump 6 to a consumer, first by an inclined segment, and then by a horizontal segment of main pipeline 7. Owing to the fact that water in pipeline 7 continuously moves, it can remain in a somewhat overcooled (below 0° C.) non-frozen state even in frosty environment. In case of moderate increase in the surrounding air temperature above 0° C. around some segment of main pipeline 7, exposition of the floated lumps of coal due to slow melting of ice and, hence, loss of floatability of the transported material in water, can be prevented by purposeful initial freezing of a porous ice coating on its surface. The thickness of the coating should somewhat exceed the minimal one required for keeping afloat the delivered cargo.

On the arrival to the destination site, coal is dehydrated from the most part of transporting water on shaker 8 and finally squeezed from its residues slipping from its icy surface on band vacuum filter 9. At that, as a result of heat exchange with the air of heated premises, where this dehydrating equipment is installed, intense melting of porous ice coating of coal lumps starts with a simultaneous filtration of thawed water through a filter fabric. On the output segment of the band of the band vacuum filter 9, lumps of coal are dried by warm air and then continuously delivered to the consumer in a dry state, as a final product of the coal pit delivered to the destination site by such continuous-flow hydraulic transport.

Filtrate left from the lumps of coal, as well as drainage and thawed waters flown down from their surface, are accumulated in static separator 10. In this separator, the two-phase flow is stratified into the lower phase—water—and the upper phase—floating organic liquid, which is delivered for combustion just as coal, while the released water is transferred to other consumers.

Thus, it is not objectively necessary to return coal-carrying water to the head of the process and to lay an idle branch of the pipeline. Respectively, besides the additional capital investments, energy consumption for water pumping back to the place of coal mining is also prevented.

At the same time, in some cases, when it is required to carry out extraction of beneficiated products in fresh form from water-salt solution using for this purpose only hydromechanical processes, it is possible to realize that regeneration of carrying medium by replacing of its rests on surface of divided minerals of other, not water liquid with set complex thermodynamic, rheological, and sanitary-and-hygienic properties, and from this organic liquid rests by subsequent replacing of water already.

Figure 8:
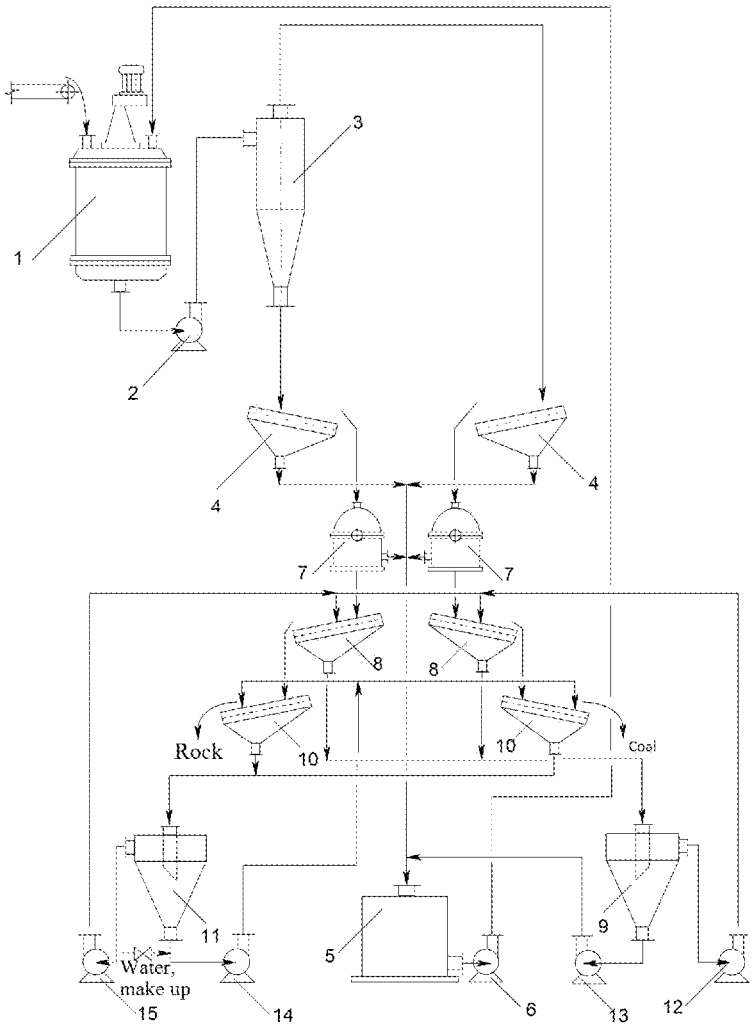
FIG. 8 is a flow diagram showing the extraction of beneficiated products in fresh form from water-salt solution, using only hydromechanical processes.
Figure 9:
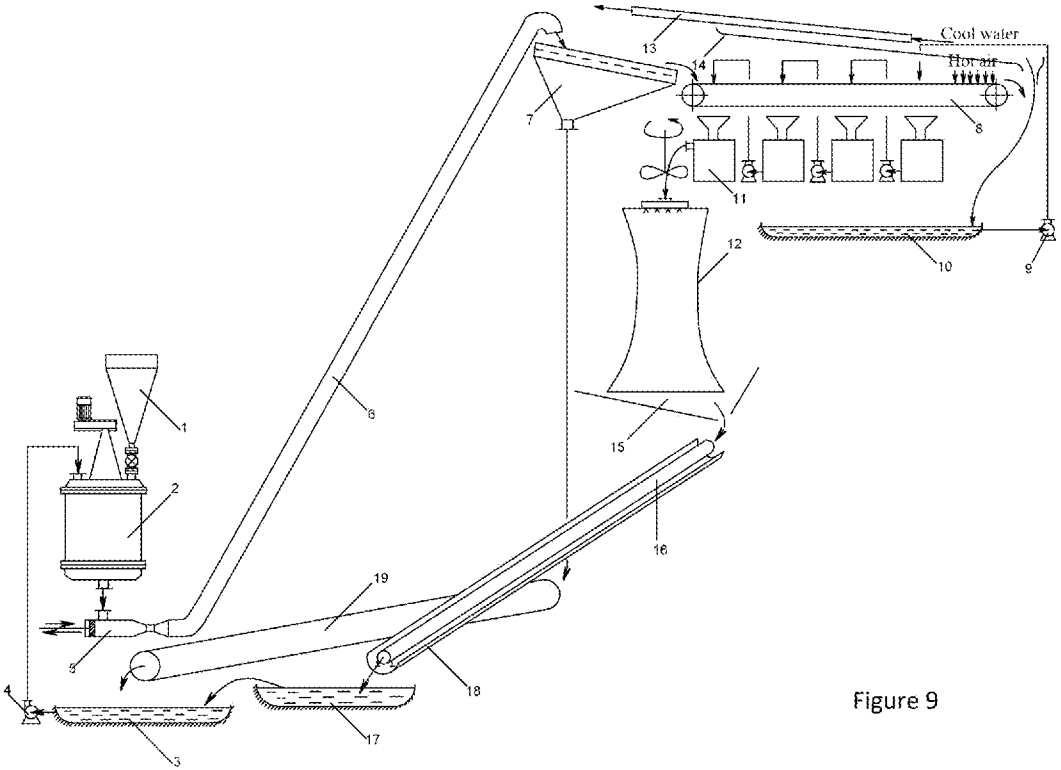
FIG. 9 is a flow diagram showing the inventive beneficiation process when it is possible to use natural heat in the process, in geographical zones with a hot arid climate.

On FIG. 8 is shown variant of such process realization.

Example 8

Crushed mined mass is mixed in mixer 1 with aqueous solution of calcium nitrate in water (density 1.47 g/sm$^3$), and fed by pump 2 into hydro cyclone 3, where minerals composing the initial raw material are irreversibly stratified into light (final tailings) and heavy (concentrate) fractions.

Concentration products are dehydrated in drainage screens 4. The released drainage flows are accumulated in collector 5 and returned by pump 6 into mixer 1 for mixing with the initial mineral.

Moist concentration products are then fed to centrifuges 7 for additional squeezing from the liquid phase, and then washed clean from the aqueous solution of calcium nitrate $Ca(NO_3)_2$ in water in hermetic vibrational sieves 8 with a physiologically inert incombustible organic liquid (hexane with an admixture of tetrafluorodibromoethane). The produced two-phase drainage flows are fed to hydrostatic separator 9.

Final tailings and concentrate wetted with organic liquid are then fed to hermetic vibrational sieves 10 and washed there with water from impregnating residues of nonaqueous liquid phase. The released two-phase drainage flows are fed to hydrostatic separator 11.

After that, concentration products impregnated with ordinary water are fed for further use; final tailings are used for stowing the worked-out area, while the concentrate is delivered to the shaft station and then drawn to the ground surface by a mine hoist.

Immiscible liquids separated in hydrostatic separators 9 and 11 are fed back to the place of their use within the technological cycle. Thus, heavy water-salt medium is pumped by pump 13 into collector 5, wherefrom the completely regenerated heavy water-salt medium is fed by pump 6 into mixer 1 for mixing with the initial raw material, i.e. to the head of the technological process. Organic washing liquid and washing water are returned by pumps 12 and 15 and, respectively, 14 to sieves 8 and 10 for concentration products washing.

Thus, both the cycle of working water-salt heavy medium and that of non-aqueous organic liquid are practically completely closed without using any thermal processes in the concentration system. This makes the technological process not only power-saving, but also ecologically clean, since in this case it can be realized in underground conditions with subsequent stowing of final tailings in the worked-out area.

At the same time, if possible to use of gratuitous natural heat, in process realization in geographical zones with hot arid climate, the question of heat consumption for circuit of used water-salt medium of work cycle loses the sharpness in view of surplus of solar energy.

The technological scheme of such transport process is presented in drawing 9, in case the coal consumer is located on higher geodetic elevated place relating place of shipment that sending coal by main pipeline transport.

Example 9

The initial lumpy coal with the density 1.366 g/cm$^3$ is fed from bunker 1 to mixer 2, where it is stirred up in the carrying medium—a mixed aqueous solution of calcium nitrate with the density 1.368 g/cm$^3$ fed by pump 4 from accumulating reservoir 3.

The hydromixture formed in mixer 2 is forwarded by piston pump 5 along transport pipeline 6 to its destination located at a higher geodesic mark.

The delivered coal is, first of all, separated from the main mass of the carrying medium on drain screen 7 and then fed to band vacuum filter 8 for deep squeezing of the liquid phase and counter-flow washing of lumps of the delivered material with fresh water taken from the accumulating reservoir 10 by pump 9.

As a result, lumps of coal are completely washed from the last residues of wetting mineral salts solution, and their surface remains wetted with fresh water only.

The final withdrawal of lumpy coal from such technological process in the dry state is realized by drying this bulk material with hot air at the last, finishing segment of the moving filter band, immediately before the descent of the transported cargo from band vacuum filter 8. Besides hot air blowing, intense solar radiation also contributes, in the daytime, to water evaporation from the coal lumps surface. Therefore, to accelerate the cargo exit in a dry state out of the transportation process, band vacuum filters equipped with enlarged black filtering band are used.

Rinsing water obtained after the counter-flow washing of coal is fed from collector 11 to the irrigation of mechanical-draft tower 12. Surface condenser 13 is installed above the latter, and the condensate flows back into the accumulating reservoir of fresh water 10 by chute 14. Partially evaporated water-salt solution accumulated at the base of mechanical-draft tower 12 flows through an inclined open fan-shaped trough 15 facing the sun into pipeline 16 laid on the earth surface. It is directed to the site of coal shipping by the supplier. On its way, this solution is additionally heated by sun and, after the arrival to the head of the transportation process, is additionally evaporated by solar radiation in the open evaporating reservoir 17. In this connection, pipeline 16 is made of highly heat-conducting metal and is painted black. Besides, it is mounted inside solar reflector 18 representing an open chute with mirror internal surface that focuses additional amount of solar energy on the bottom side of pipeline 16.

Water-salt solution completely evaporated up to its initial density flows from evaporating reservoir 17 into accumulating reservoir 3, wherefrom it is fed into the transportation process again.

Meanwhile, the main flow of the carrying water-salt medium separated from the coal is fed, after hydromechanical separation of hydromixture delivered to its destination, in the opposite direction into accumulating reservoir 3, to the coal shipping site, by the main idle branch 19, which can be located underground.

Thus, the technological cycle of the carrying medium used in such transport process is practically completely closed, without any conditioned power supply sources. At a careful closure of all main and auxiliary equipment and high production standards, mineral salts increasing the weight of water solution in such circulation loop are not practically consumed, not to speak about the fact that such transportation system is not an irreversible consumer of any hydrocarbon auxiliary materials.

The following, after underground beneficiating of coal, key transport link of offered technological chain of the declared method is coal delivery on terrestrial surface by its buoyancy in liquid with density exceeding it.

However, to load such loose cargo in vertical transport pipeline with height in tens (at open-pit mining), and hundred (at underground mining) meters, it is necessary to overcome hydrostatic pressure of so high column of heavy liquid.

Figure 10:
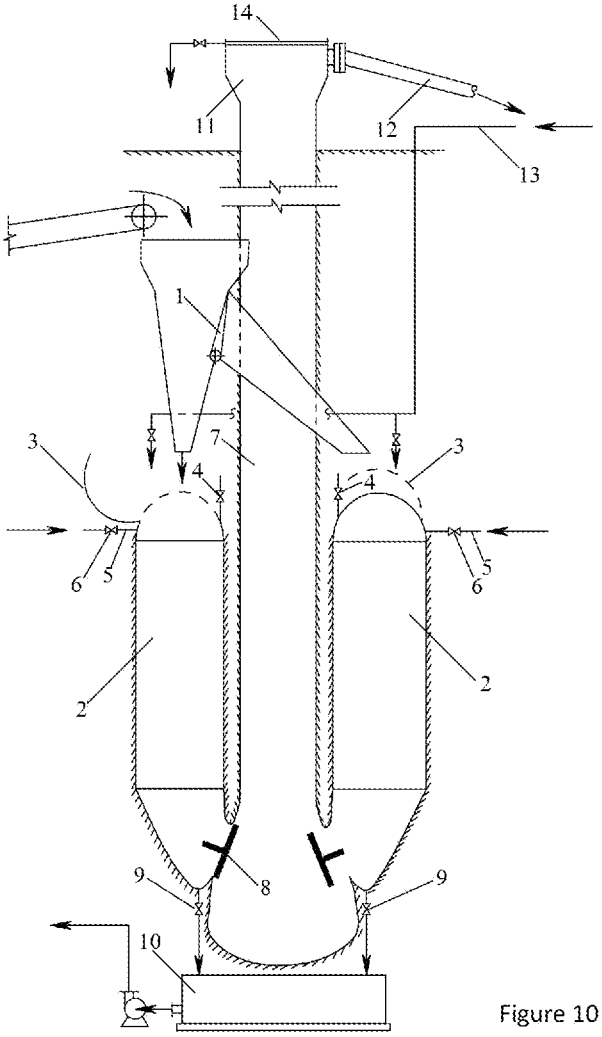
FIG. 10 is a flow diagram showing the loading of loose beneficiated coal in a high-pressure vertical transport pipeline, such as in open-pit mining and underground mining.
Figure 11:
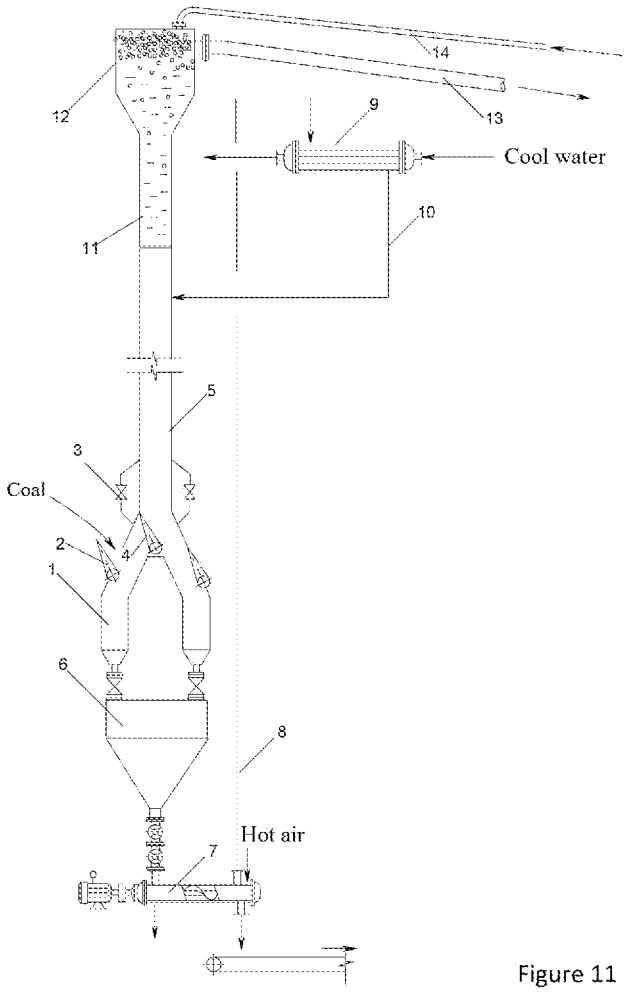
FIG. 11 is a flow diagram showing a combined lifting and concentrating process used when loading coal from very deep mines.
Figure 12:
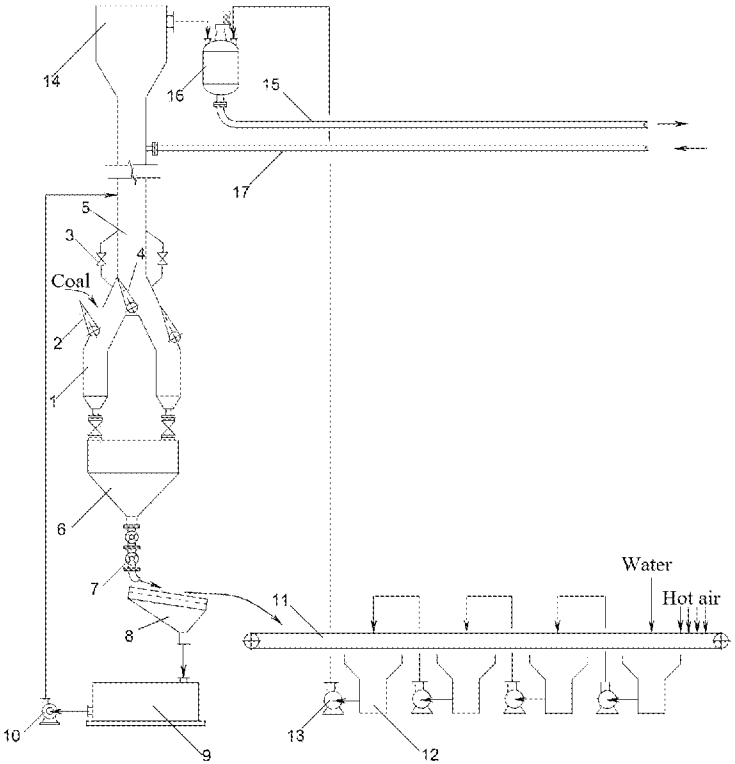
FIG. 12 is a flow diagram showing a beneficiatinq-transport process which combines the underground beneficiatinq of coal with the subsequent transport of the coal to the earth's surface in a vertical pipeline.
Figure 13:
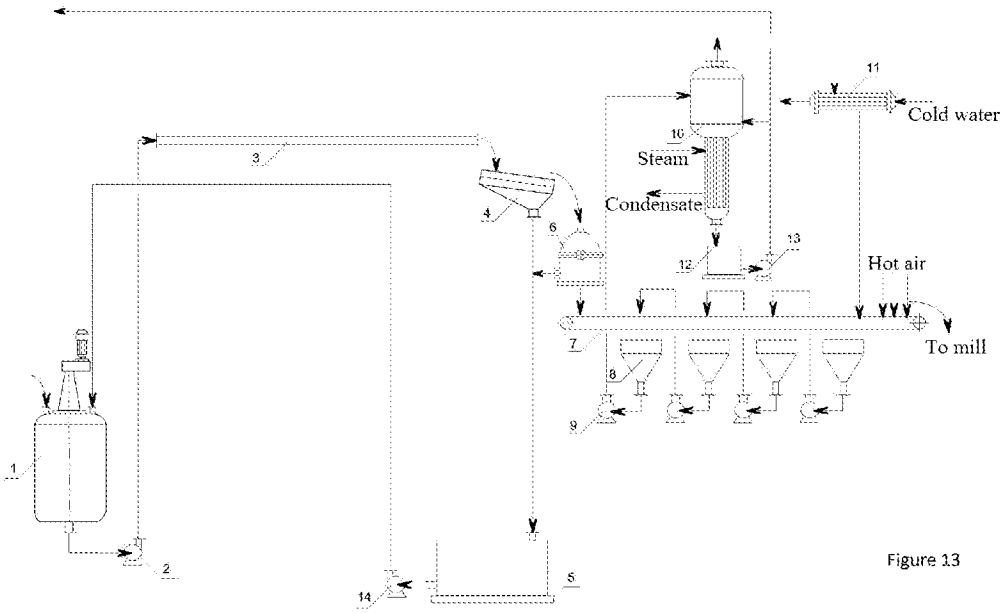
FIG. 13 is a flow diagram showing a transport system for supplying solid fuel to thermal power plants.

The technological scheme of realization of such loading operation is shown on FIG. 10.

Example 10

Loading of such loose cargo in high pressure pipeline is carried out as follows.

Arrived in continuous stream from mining faces of mine lumpy coal (true density of 1,394 g/sm3), by closing gate 1, alternately load in one and in another the reception chambers of the loading device of its hydrostatic lifting system, executed in the form of hermetic winzes 2.

Loaded into the left winze 2, the next portion of coal completely immersing it in the water-salt medium which representing, for example, 40%-s' solution of carbonate potassium (K2CO3) in water with density 1,412 g/sm3, and fill in over minor of surface of the hydromix primary layer hydraulic oils with density of 0.890 g/sm3, immiscible with water of the hydraulic liquid, then cover 3 of loading hatch tightly batten down (in the closed position, the cover of the hatch of the left winze is conditionally shown by shaped line), and, without stopping filling in some oil, open the air crane 4.

When instead of pitted air, on exit, from the air crane 4 there will be first drops of oil, this lock body also is closed, and, by oil pipe 5 with the crane 6, in the completely pressurized winze 2 start to compress hydraulic oil under pressure created by hydraulic oil station (in drawing conditionally it is not shown), exceeding hydrostatic pressure of water-salt solution column in the transport pipeline 7. As a result, the return valve 8 pressurizing, achieving of the certain moment, the transport pipeline 7 opens, and, the next portion lumpy coal, suspended in solution of carbonate potassium in water, from a winze 2, is squeezed out in vertical column of such water-salt medium. After that, in winze 2 emptied from the next portion of coal, stop filling in hydraulic oils under elevated pressure, and, opening of the crane 9, start to drain this not water hydrocarbonic liquid in the collection tank 10. Then pressure in winze 2 starts to fall gradually, and, the return valve 8, under much bigger pressure from external side rather than internal, automatically comes back in the starting position, again tightly locking vertical column of the heavy water-salt medium in the transport pipeline 7. Thus, the air crane 4 again open, replacing following of winze 2 hydraulic oil with miner air. On the ending of this not aqueous liquid drain, cover 3 of the hatch of winzes 2 again open, and, turning locking gate 1, and again put the next portion lumpy coal in to such reception chamber.

In time of loading in the left winze 2 next portions of coal, just the same procedures on coal squeezing in the transport pipeline 7 are conducted in the right winze 2 which work counter phase with it. Thus, recurrence of loading smoothes out, and delivery of coal from mine by its buoyancy in the heavy water-salt medium occurs almost in continuous stream.

Coming out from mine on terrestrial surface lumpy coal, by its buoyancy in water solution of carbonate potassium, accumulates in the form of friable 'cap' in pressure head tower 11 from which further it is delivered to the consumer by continuous stream in drifting mode in such heavy water-salt medium carrier, to place of delivery by main pipeline 12.

On arrival of transported material at destination, is carried out the hydromechanical separation of lumpy loose cargo from the carrying solution of carbonate potassium in water and definitive extraction of coal from it in dry and completely demineralized form, then definitively regenerated water-salt medium by second pipeline 13, return back in colliery, to place of coal loading.

Casually got, together with coal, in the transport pipeline 7, drops of hydraulic oils, also is buoyancy in such water-salt medium by high pressure pipeline 7 in pressure head tower 11, forming on mirror of surface of solution a layer of not water liquid 14. In process of accumulation some appreciable quantity of this oil, periodically send it back, in colliery, to the place of filling in it to the next portion of hydromix.

Thus, the cycle of use in such hydraulic transport process both the heavy water-salt medium and light, immiscible with it, hydrocarbonic liquid, closing practically totally.

Use of the declared offer, comparing to known methods of loading lumpy loose cargoes in high pressure main pipelines, provides to it variety of important technical and economic advantages consisting in cardinal simplification of constructive design of process, decrease its power consumption, and several times increase its productivity because for loading material in to working cylinder of such hydraulic device, are not used any mechanical parts that allows to increase its diameter till the sizes limited geomechanical conditions of underground construction of vertical mine developments with the cross-section dimensions capable successfully to resist at their emptying, to high mountain pressure upon the big and super big depths of conducting underground mining works.

Proposed coal loading procedure in column of the heavy water-salt medium is, nevertheless, energy-requiring as oil station has electric drive for squeezing out not water hydraulic liquid on surface mirror.

At mining of coal from deep, and especially, super deep mines air temperatures are all year kept at high enough constant level, and coal loading in such vertical column of heavy liquid can be carried out by recycling of gratuitous heat of bowels without additional power resources for this purpose. Moreover, even at presence in coal directed on delivery from colliery pieces of breed, the delivered coal to terrestrial surface released from such ballast as dead rock, being heavier, in comparison with liquid used in such of hydrostatic lifting system, can't buoyance on terrestrial surface, and remains in mine with its subsequent replacing to the developed space in dry form.

The technological scheme of such combined lifting and concentrating process is shown in drawing 11.

Example 11

Locking gate 2 opens and ordinary lumpy coal is loaded into one of trouser-legs of the loading lock device 1. After loading of the next party of the extracted material, gate 2 tightly close and by opening of the crane 3, fill in to solid lumpy material loaded in such tight chamber a fluid of the transport pipeline,—non viscous, easy steamy, physiologically inert, nonflammable, and an immiscible water based liquid, with intermediate density between coal and dead rock.

As such liquids use completely fluorinated hydrocarbons of alkane homological row, so-called perfluorcarbons, or their mixes among themselves, the basic physical properties which are presented below:

TABLE 1

| Name | Chemical formula | Density, g/sm$^3$ | Normal boiling temperature, ° C. |
|---|---|---|---|
| Perfluoromethane | $CF_4$ | 1.96 | −128.0 |
| Perfluoroethane | $C_2F_6$ | 1.85 | −78.2 |
| Perfluoro propane | $C_3F_8$ | 1.48 | −38.0 |
| Perfluoro cyclopropane | $C_3F_6$ | 1.55 | −30.0 |
| Perfluoro butane | $C_4F_{10}$ | 1.63 | −2.0 |
| Perfluoro cyclobutane | $C_4F_8$ | 1.72 | −5.8 |
| Perfluoro pentane | $C_5F_{12}$ | 1.62 | 29.3 |
| Perfluoro cyclopentane | $C_5F_{10}$ | 1.72 | 22.4 |

As we see, density of every easy steamy not aqueous liquids of this kind are strictly in intermediate area, between coal (1.3 . . . 1.5 g/sm3) and dead rock (2.5 . . . 2.7 g/sm3). Therefore, coal, being loaded into such liquid, for example, the mix of perfluorocyclopentane with perfluorocyclobutane, density 1.72 g/sm3, and boiling temperature 18° C., after shift gate 4 in the right position, buoyance in the vertical transport pipeline 5 from mine on terrestrial surface, whereas dead rock plunges into the receiving bunker-thickener 6. In it, tailing product which has settled in such not water medium is thickening. Then, damp dead rock load in an expanser-dehydrator 7 which its case is warmed with warm miner air where temperature in the big depths, is at level 45 . . . 55° C. all year, irrespective of meteorological conditions on terrestrial surface.

As a result of such deaf heat exchange, the mix of perfluorocyclopentane with perfluorocyclobutane, impregnated to tailing rocks, boils and its formed steams by steam line 8, rise on terrestrial surface where installed condenser 9 which cooled by cold water flow (temperature of 14° C.). As consequence, in such heat exchanging device occurs liquefaction of working body of closed lifting and concentrating cycle and completely recycled, thus, non-aqueous heavy easy steamy liquid comes back again in the transport pipeline 5 by condensate line 10.

To avoid boiling up of mix of perfluorocyclopentane with perfluorocyclobutane in the pipeline 5, the column such compressible gas in essence, is flooded by lighter, comparing to such organic medium, immiscible with it, water liquid, which is used as for carrying water-salt medium 11. It fills in not only pressure head tower 12, but, also shield non-aqueous compressed gas medium on the top of the transport pipeline 5, leveling necessary height which can exclude its boiling up in such vertical column.

In a role of such carrying and shielding medium acts, in this case, the solution of mineral salt in the water, specially prepared for this purpose with slightly lower density, in comparison with the heavy not water liquid used for hydrostatic lifting, for example, 40%-s' solution of chloric iron FeCl3, having density 1.42 g/sm3.

The beneficiated coal which buoyancy from mine, gathers on mirror of a surface of such water-salt medium and in this stream further is delivered to destination by main pipeline 13.

Return of carrying medium back to the pressure head tower 12, is carried out in second pipeline 14.

Thus, using two immiscible among themselves liquids become possible to carry out combination of lifting of coal from mine with its beneficiating and a extraction of burrow breeds for replacing in dry form.

However, on small depths of conducting underground mining works, and also at coal delivery on a terrestrial surface at its open extraction, there is no necessary contrast of temperatures between rocks containing a coal layer, and weather conditions on a terrestrial surface In this case, the extraction of burrow breeds for replacing in dry and completely demineralized form, at a combination of underground beneficiating of coal with its subsequent buoyance on a terrestrial surface in the vertical pipeline, is based on that circumstance that, for delivery of solid fuel by main pipeline the carrying medium density isn't required, which is obliged as at hydrostatic lifting to surpass density of a material transported in it The essence of such approach to construction of the simplest, this sort of, beneficiating-transport process, is explained by drawing 12.

Example 12

Brought to shaft yard big size ordinary coal load into one of trouser-legs of the lock loading device 1, in the heavy water-salt medium representing, for example, 52%-s' solution two-replaced ортофосфата of potassium (dipotassium phosphate $K_2HPO_4$) which density, at temperature of 25° C., is equal 1.56 g/sm3

After hermetic sealing, means gate 2, the next portion of ordinary coal, which immersing it in the water-salt medium by opening of the crane 3, and transfer gate 4 in the right position, a coal concentrate as part of loaded material buoyance on surface in the transport pipeline 5 whereas burrow breed, being heavier component of an initial mix of minerals, settle down into the bunker-thickener 6.

The extracting of coal beneficiating burrow tails from such water-salt medium is carried out by means of the cascade of lock shutters 7 then, this tailing material first release from the basic volume of the heavy liquid on vibrating screen 8. The drainage drains which have departed thus arrive in the collection tank 9 from which, by pump 10, this water-salt solution again transfer in the transport pipeline 5.

Final releasing of tailing material, that further place in developed space, from last rests of the water-salt medium, carry out by counter flow multistage washing of coal beneficiation burrow tails on the ribbon vacuum-filter 11 in which at end, washed lump coal dry warm air then, place in the nearby developed space.

The washing waters which represent the diluted solution dipotassium phosphate in water, accumulate in the collection tank 12 from which by pump 13 them pump out on a surface, and use for carrying medium density reducing, before coal sending to destination from a pressure head tower 14.

For this purpose, before coal input in the main pipeline 15, correcting of density of the carrying medium carry out in the mixer 16. Delivery of such energy carrier is carrying out then in less concentrated water solution to the consumer, which use this high-quality solid fuel for power generation.

The coal extracting in dry and completely demineralized form from water-salt solution, at the place of its burning, is carried out with use of waste heat of such object of power system, subject to dispersion in atmosphere anyhow. However, thus, regeneration of the carrying medium is carried out not to density of the carrier, but to density of the motionless solution used as a heavy liquid in the transport pipeline 5. Return of this technological stream to a head of such beneficiating-transport process is carried out on second pipeline 17.

Diluting of carrying medium to comprehensible level not only lowers its viscosity, and with it the power expenses related delivery of solid fuel by main pipeline 15, but also prevents possibility of coal blockage in peaks of zigzag sites of the line.

Meanwhile, the density to which the water-salt solution can be diluted for use as the carrying medium for main pipeline transport of coal is depends on velocity of flow in the pipeline, and also particle size of transported material.

In more details this question is reflected in following example of realization of transportation of coal, illustrated drawing 13.

Example 13

Hydromix of hard coal subject to transportation (density of coal of 1.35 g/sm3), with the particle sizes of 15 . . . 25 mm, dilute in the mixer 1, adding washing waters of tails washing of underground coal beneficiating by counter flow, to density of carrier 1,282 g/sm3, with ratio of solid and liquid phase in this stream equal 1:1 by volume.

Formed, thus, hydromix, consisting half from coal, and half from the carrying medium, by pump 2, through transport pipeline 3 with diameter 0.2 meters, pump till speed of buoyancy of particles of such loose cargo, calculated under the formula (I) figure Formulas.

To use this formula, first we will calculate value of factor of contrast of density of components of such hydromix:

$$a=(\rho_s-\rho_1)/\rho_1$$

Here, we receive:

$$a=(1350-1282)/1282=0.053$$

Then, considering that the coal volume fraction in a hydromix is 0.5, expression in brackets equal to value:

$$1-0.053\times0.5=0.9735$$

Now we will multiply it by acceleration of free falling g and diameter D of the pipeline and then we will extract a square root from creation (2) figure Formulas.

The relation between density of solid and liquid phase's $\rho_s/\rho_1$ in the pumped flow is equal:

$$1350:1282=1.053$$

Accordingly, the cubic root of this number is equal (3) figure Formulas.

Now, for substitution value of factor k in the above-stated formula, we will look the table data in which the interrelation of this size with particle size is shown.

TABLE 2

| | Average diameter of particles of transported material, d, MM | | | | |
|---|---|---|---|---|---|
| | 0.5 . . . 2.0 | 2.0 . . . 7.0 | 7.0 . . . 15.0 | 15.0 . . . 25.0 | 25.0 . . . 50.0 |
| K factor value | 1.0 | 1.15 | 1.30 | 1.45 | 1.70 |

For particle size of transported coal, in this case 15.0 . . . 25 mm, value of the factor would 1.45.

Thus, speed to which the hydromix stream in the 200 mm diameter transport pipeline should be reached, should be:

$$v=1.45\times1.0174\times1.382=2.04\ \text{M/sec}$$

Now we will calculate throughput of pumped coal of such transport artery.

The cross-section area of 0.2 m diameter transport pipeline is:

$$S=\pi R^2=3.14\times0.1^2=0.0314\ \text{M}^2$$

Accordingly, at hydromix flow velocity of 2.04 m/s, volume throughput of the transport system per second will:

$$0.0314\times2.04=0.064\ \text{M}^3/\text{sec},$$

Or, per hour:

$$0.064\times3600=230.6\ \text{M}^3/\text{h}$$

However, only half of this volume is coal. Accordingly, volume productivity of such transport pipeline on coal will:

$$230.6\times0.5=115.3\ \text{M}^3/\text{h};$$

In recalculation on the mass flow, considering the density of coal equal to 1350 kg/m3, through 200 mm diameter pipeline per year, it will be continuously delivered to the consumer:

$$115.3\times1.35\times24\times365=1.363.547\ \text{t/year}=1.36\ \text{Million-.ton/year}$$

However, unlike known traditional methods of coal hydrotransport, which deliver to the consumer only coal fine, the proposed method provides, finally, to client to receive coal in lump form, instead of the paste, which separating it from carrying medium doesn't represent any technical difficulties.

For this purpose, arrived to destination hydromix, first enter on hydromechanical separation of solids from liquid on drainage vibrating screen 4. Drained, from coal pieces, the liquid phase, thus, gathers in the reception tank 5 whereas preliminary dehydrated solid material passes deep hydromechanical wringing from the rests of the water-salt carrying medium kept on its surface on a filtering centrifuge 6 in a powerful centrifugal field, the filtrate from which also arrives in the same accumulating tank 5, as the drainage drains which have departed from vibrating screen 4.

Washing from the remained traces of the water-salt medium from a surface of damp pieces of coal carry out on the ribbon vacuum-filter 7 in counter flow regime by fresh water, then the formed washing waters from the tank 8, sending by pump 9 for evaporation to the evaporating device 10.

Completely washed already from last traces of mineral salt, damp pieces of coal, then, before a descent from the ribbon vacuum-filter 7, dry by hot air on existing part of ribbon adjoining to drum drive and transfers to system of a grinding from which ready dry coal dust feeds in a fire chamber of steam-power installation for burning.

Pure water steam leaving the evaporating device 10, condense in the condenser 11, and, the received hot fresh water, thus, again submit to ribbon vacuum-filter 7, to cycle of counter flow washing of coal pieces.

The strong water-salt solution evaporated in the evaporating device, from circulating collection tank 12, is transferred by pump 13 to head of transport process through branch pipeline.

As a result, the transport cycle, in relation of the carrying water-salt medium used in it, completely circuits, and, as consequence, the irreversible loss of dipotassium phosphate, or any other mineral salt used in such system, at right operating of transport process, and trouble-free operation of equipment, is almost close to zero.

Thus, use of such way for solid fuel supply to thermal power stations, guarantees to such transport system an elimination of any blockage in any, even in the most peaked, breaks of a working configuration of the pipeline, at essential decrease thus the expense of all kinds of power resources on realization of such transport process, and reduction of water consumption by it as, for coal washing from the rests of less concentrated carrying medium it is required less washing water.

The complex concentration-and-transportation method of the invention offers a number of technical, economic and ecological advantages in comparison with known concentration and transportation technologies applied in coal and power production. They are based on multiple functions of one and the same fluid, which is used as a medium for wet selective grinding of the initial raw material, as a separating medium for precise coal concentration, as a motionless heavy liquid for the floatation of concentrated combustible mineral from a mine to the surface under the conditions of hydrostatic lifting, and also as a carrier medium for the delivery of ready lumpy solid fuel to its destination by a main pipeline in unlimited extent, without use any transshipment operations, thus.

Additional floatability is imparted to the combustible mineral by screening it with various low-melting low-density coatings. The latter not only reliably insulate the surface of such bulk cargo lumps against contacts with water-salt media at their delivery to units that have no low-grade power sources, but also allow the usage of heavy liquids of lower density, which reduces power consumption for the realization of such transportation process and facilitates the procedure of their regeneration.

Taking into account the on-the-line character of such concentration-and-transportation process, increased quality grade and improved consumer properties of the delivered solid fuel, as well as the absence of any mechanical losses on its way from the mine to the furnace of thermoelectric power station, the method of the invention provides a cardinal reduction of the delivery price of the high-quality energy carrier, which is used, at the same time, as a free carrier of methane included of such a 'container', not to mention ecological aspects of the operation of such fuel/power system in any season and at any geographical latitudes.

Refusal of land construction of coal beneficiating factory results not only significant reduction of capital investments on building of coal mining objects, but also liquidates damage from placing waste rock from beneficiation in the territory adjoining to a colliery, giving possibility to use tailing rocks of underground coal beneficiation as free replacing material for efficient control geomechanical processes displacement overlying thickness of rocks, and protection, thereby, land objects from destruction, due to subsidence of terrestrial surface.

Sequence List Text

The invention claimed is:

1. A method of beneficiating a mineral fuel and delivering the mineral fuel to a consumer by pipeline, comprising the steps of:

separating an initial rock mass at a mine into a plurality of size classes of rock;

further grinding at least one of the size classes of rock into a ground product;

submersing the ground product, together with a powdered part freed from the initial rock mass, in a fluid having a density between a density of the mineral fuel and a density of a waste rock;

stratifying the mineral fuel from the waste rock in the fluid;

subsequently drawing the mineral fuel to the earth's surface by floating the mineral fuel in the fluid whose density exceeds that of the mineral fuel;

delivering the mineral fuel to the consumer by a pipeline containing the mineral fuel and the fluid;

removing the fluid from the mineral fuel and returning the fluid to the mine;

regenerating the fluid by removing waste products contained in the fluid; and also imparting additional floatability to the mineral fuel by coating the mineral fuel with both aqueous media having mineral salts dissolved therein, and non-aqueous volatile liquids and liquefied gases having a density between the density of the mineral fuel and the density of the waste rock.

2. The mineral fuel beneficiation and delivery method of claim 1, wherein the method also includes using a solution of a water-soluble mineral salt as a liquid in grinding at least one of the size classes of rock.

3. The mineral fuel beneficiation and delivery method of claim 1, wherein the method also includes removing a residue of a water-salt medium from the mineral fuel delivered to a thermoelectric power station, rinsing the mineral fuel with water and subsequently evaporating the rinsing water by the waste heat of the thermoelectric power station.

4. The mineral fuel beneficiation and delivery method of claim 1, wherein the method also includes removing a residue of a water-salt medium from the waste rock by washing the waste rock with a volatile organic solvent, and subsequently drying the waste rock using a heat of the mine and condensing a vapor of the volatile organic solvent.

5. The mineral fuel beneficiation and delivery method of claim 1, wherein the method also includes concentrating the powdered part of the initial rock mass in a cryogenic liquid medium having a density between the density of the mineral fuel and the density of the waste rock, thereby generating a coal concentrate powder, and liquefying a vapor of the cryogenic liquid and returning the liquefied vapor to the cryogenic liquid medium pressing the coal concentrate powder into cylindrical blocks, delivering the cylindrical blocks to the consumer in a water-salt medium by the pipeline, removing a residue of the water-salt medium from the cylindrical blocks by washing the cylindrical blocks with water, and drying and grinding the cylindrical blocks at the consumer in a hermetic mill and capturing the methane generated thereby.

6. The mineral fuel beneficiation and delivery method of claim 1, wherein during a summer period, the method also includes pressing powdered coal into hollow hermetic cylinders, drawing the hollow hermetic cylinders to the earth's surface, and delivering the hollow hermetic cylinders to the consumer by floating the hollow hermetic cylinders in flowing water.

7. The mineral fuel beneficiation and delivery method of claim 1, wherein during a winter period, the method also includes freezing an ice envelope impermeable to a water-salt medium on a surface of the mineral fuel before placing the mineral fuel into a non-freezing water-salt medium, melting the ice envelope with air at the consumer, and hydromechanically separating a residue of residues of the water-salt medium from the mineral fuel.

8. The mineral fuel beneficiation and delivery method of claim 1, wherein during a summer period, the method also includes applying a water-tight coating of a low density low-melting organic material to a surface of the mineral fuel before submerging the mineral fuel into a water-salt medium, removing the organic material from the mineral fuel by its melting the organic material and hydromechanically separating the organic material from the mineral fuel, and stratifying the obtained two-phase flows into two immiscible liquids for reuse in the method or use of the organic material as an additional hydrocarbonic fuel.

9. The mineral fuel beneficiation and delivery method of claim 1, wherein in the absence of thermal energy sources, the method also includes removing a residue of a water-salt medium from the mineral fuel by first washing the mineral fuel with a non-aqueous liquid that is immiscible with water, and then washing the mineral fuel with water, and then stratifying the obtained mixtures of immiscible liquids for reuse in the method.

10. The mineral fuel beneficiation and delivery method of claim 1, wherein during a summer period, the method also includes removing a residue of a water-salt medium from the mineral fuel by washing the mineral fuel with water and subsequently evaporating the washing water by solar radiation.

11. The mineral fuel beneficiation and delivery method of claim 1, wherein the method also includes loading the mineral fuel produced underground into a vertical column using a water-salt medium, by flooding a portion of mineral fuel with the water-salt medium in a hermetic underground tank, and discharging under pressure a formed hydromix of the mineral fuel and the water-salt medium from the hermetic underground tank using an immiscible non-aqueous liquid.

12. The mineral fuel beneficiation and delivery method of claim 1, wherein the method also includes transporting the mineral fuel to the earth's surface using a non-aqueous liquid medium that fills a vertical transporting pipeline, wherein a boiling temperature of the non-aqueous liquid medium is lower than an air temperature of the mine and higher than a temperature of the earth's surface surrounding the mine, and using a water-salt medium as a carrier for further transporting the mineral fuel to the consumer, subsequently extracting the waste rock which has precipitated in the vertical transporting pipeline, drying the waste rock with air from the mine, storing the waste rock in a mined-out space of the mine, and liquefying volatile vapors that are released from the waste rock by condensing the volatile vapors on the earth's surface.

13. The mineral fuel beneficiation and delivery method of claim 1, wherein in the absence of free heat sources, the method also includes using a water-salt medium for hydrostatic lifting and as a carrier medium for delivering the mineral fuel by pipeline to a thermoelectric power unit, removing a residue of the water-salt medium from a surface of the waste rock which has precipitated in a vertical column of liquid by washing the waste rock with water, and diluting the water-salt medium used for hydrostatic lifting with the water which was used for washing the waste rock.

* * * * *